United States Patent [19]

McClure

[11] Patent Number: 5,000,377

[45] Date of Patent: Mar. 19, 1991

[54] POST CONSTRUCTION

[75] Inventor: Jack A. McClure, Garden City, Kans.

[73] Assignee: Inland Container Corporation, Indianapolis, Ind.

[21] Appl. No.: 462,968

[22] Filed: Jan. 4, 1990

Related U.S. Application Data

[63] Continuation of Ser. No. 189,993, May 4, 1988, abandoned.

[51] Int. Cl.[5] ..... B65D 5/20

[52] U.S. Cl. ..... 229/154; 229/150; 229/918; 229/919; 229/DIG. 11

[58] Field of Search ..... 229/141, 154, 190, 191, 229/918, 919, 920,DIG. 4, DIG. 11, 178, 150

[56] References Cited

U.S. PATENT DOCUMENTS

| | | | |
|---|---|---|---|
| 1,207,899 | 12/1916 | Greve | 229/191 |
| 2,857,090 | 10/1958 | Fallert | 229/190 |
| 3,228,710 | 1/1966 | Chodorowski | 229/920 |
| 3,899,123 | 8/1975 | Stollberg et al. | 229/DIG. 4 |
| 4,056,223 | 11/1977 | Williams | 229/190 |
| 4,129,247 | 12/1978 | McCall | 229/178 |
| 4,244,507 | 1/1981 | Garmon | 229/150 |
| 4,319,710 | 3/1982 | Osborne | 229/190 |
| 4,676,428 | 6/1987 | McClure | 229/920 |

*Primary Examiner*—Gary E. Elkins

*Attorney, Agent, or Firm*—Fitch, Even, Tabin & Flannery

[57] ABSTRACT

An integral carton blank from which a carton is formed having an end with three upstanding carton walls forming a pair of spaced-apart outside corners with reinforcing corners nested within each outside corner. The reinforcing corners are formed of reinforcing shoulders integrally joined to the end walls of the carton. Each reinforcing shoulder has three panel portions, two overlying a side wall and one overlying an end wall. Substantial portions of the panels of the reinforcing shoulder engage a floor of the carton to provide improved compressive strength.

10 Claims, 3 Drawing Sheets

POST CONSTRUCTION

This application is a continuation of application Ser. No. 189,993, filed May 4, 1988, now abandoned.

BACKGROUND OF THE INVENTION

1. Field of the Invention

The present invention pertains to corrugated cardboard cartons and the like constructed from an integral blank to have internal flap members which are folded to provide a corner post support.

2. Brief Description of the Prior Art

Corrugated cardboard boxes are used today in many applications where relatively inexpensive lightweight containers, which may be shipped and stored in a compact configuration, are required. Different types of corrugated cardboard containers have been developed with either a unitary or a multiple component construction. Multiple components can, for example, be added to a corrugated cardboard container to improve its bursting or alternatively, its load-bearing strength. However, the use of multiple components for a container increases the material costs thereof, as well as labor costs, in providing the container to an end user. It is generally preferred that, if at all possible, a corrugated cardboard container is fabricated from a unitary blank which is folded into the desired container configuration. It is generally desirable that a corrugated cardboard blank have a design which is as efficient as possible, particularly for large production runs in which even small cost savings are magnified many times over.

Even in those applications where the strength of a corrugated cardboard container may be tested to its maximum limit, many users still prefer corrugated cardboard construction due to the cost savings thereof, as well as the ability of a carton manufacturer to at least partially preassemble the carton, thereby requiring the end user to supply only a modest amount of labor to complete the carton construction. Corrugated cardboard containers are also preferred because of their inherent lightweight and thermal insulation properties.

One particular application for corrugated cardboard containers which require, considerable container strength and which utilizes the insulation properties of the corrugated cardboard material is the meat packing industry, which uses corrugated cardboard containers to ship and store frozen meat products. Corrugated cardboard containers, for applications of this type, must exhibit substantial strength when one carton is stacked upon another, since even a carton of relatively small volume can hold frozen meat contents of considerable weight. When such cartons are stacked one on top of the other, the lowermost cartons need to bear the aggregate weight of the stack. Due to the relatively heavy weight of the frozen meat products, the loading applied to the lowermost carton can cause the carton to collapse, unless special measures are taken to prevent such collapse.

Unlike other products, such as reams of paper and the like, pressure on meat products disposed within the cardboard container must be avoided, because of their perishable nature. Accordingly, there is frequently provided a gap between the top of the carton contents and the top wall of the carton, with the top wall of the carton being supported internally, and when the weight of overlying carton is applied in compression to the side walls of the bottom carton. To provide a carton with greater strength so as to reliably withstand heavier loads stacked on top thereof, the carton can be made from thicker or heavier gauge cardboard material. However, there is a practical limit to the added strength and manufacturing economy of such carton constructions.

One option available to a carton designer is to provide additional, overlying walls to support or reinforce the outside, vertical walls of the carton. As mentioned above, it is generally preferable that such additional reinforcing walls, as with any component of carton, be obtained from a single unitary blank from which the carton is formed, so as to reduce assembly costs. One approach to improving the strength of corrugated cardboard cartons is to provide additional support only at the corners thereof, and not at mid-sections of vertical carton side walls, for example. For the reasons pointed out above, there is a demand for corrugated cardboard cartons having corner reinforcements of improved strength, especially such cartons formed from the unitary blank which need not have an increased size.

SUMMARY OF THE INVENTION

It is an object of the present invention to provide a corrugated cardboard carton having reinforcement at its corners, which enhances the ability of the carton to support heavy weights stacked on top thereof.

Another object of the present invention is to provide a corrugated cardboard carton of the above-described type formed from a single unitary blank which, by simple folding and gluing operations, forms a completed container construction.

Yet another object of the present invention is to provide a corrugated cardboard container of the above-described type having reinforcement at its corners which extends greater distances toward adjacent corners, yet which does not require additional material in the unitary carton blank.

These and other objects which will become apparent from studying the appended description and drawings, are provided in a carton blank from which a carton is formed, having an end with three consecutive upstanding walls forming a pair of spaced-apart outside corners, with reinforcing shoulders nested within each outside corner comprising a floor panel having two pairs of opposed edges, with side wall panels joined to a first pair of opposed edges of the floor panel, and with top cover panels on either side of the side wall panels. End wall panels are joined to the second pair of opposed edges of the floor panel by respective flexible joint lines, each end wall panel having a pair of generally opposed lateral edges. A reinforcing shoulder extending from each lateral edge of the end panels includes first, second and third serially adjacent reinforcing panels, the first reinforcing panel hingedly connected to a lateral edge of the side wall panel along a first hinge line, and the first, second and third reinforcing panels of each reinforcing shoulder, extending along one side of adjacent side wall and top cover panels. Second hinge lines join each pair of first and second reinforcing panels, so that the second and the third reinforcing panels can be folded against the first reinforcing panel and the end wall, respectively. Third hinge lines separate the second and the third reinforcing panels, and are positioned to lie adjacent the first hinge line when the second and third reinforcing panels are folded about the second hinge line. The third reinforcing panels are configured to have a lower edge lying immediately adjacent the joint line joining the end wall and floor panel, when the second and the third reinforcing panels are folded about the second hinge line. The first and second panels are thereafter foldable about the first and the third hinge lines, so that the lower edges thereof and the lower edges of the third reinforcing panel, are positioned immediately adjacent the floor panel when the side wall is folded about the joint line toward the floor panel. The edges of the first, second and third reinforcing panels together comprise a substantially continuous edge forming a colinear extension of the joint line, whereby the first, second and third reinforcing panels cooperate to form a reinforcing shoulder reinforcing an adjacent side wall and end wall.

Other objects and advantages of the present invention are attained in a carton blank from which a carton is formed having two opposed ends, each end including three consecutive upstanding wall portions which form a pair of spaced-apart side corners, with reinforcing shoulders nested within each outside corner. The blank includes a generally rectangular sheet of carton material defining three columns, a central column and two outer columns. The central column includes a centrally located floor panel, side wall panels on either side of the floor panel, and cover panels on either side of the side wall panels. Each outer column includes a centrally-located end wall generally coextensive with the floor panel, and a reinforcing shoulder on either side of the end wall, generally coextensive with a laterally adjacent side wall and top cover panel of the central column. Each reinforcing shoulder has a first panel hingedly connected to one lateral edge of the end wall, a second panel on either side of the first panels, and a third panel on either side of the second panels. The side wall and top cover panels, and the reinforcing shoulders define a generally straight, dividing cut line colinear with the joint line, joining the end wall and floor panel. A third reinforcing panel of each outer column extends to a free edge of one top cover panel, and the third reinforcing panel of the other reinforcing shoulder has an edge adjacent the dividing cut line, extending along a substantial portion of the other top cover. The first and second reinforcing panels are joined by a second hinge line, and the second and third reinforcing panels are joined by a third hinge line. The first, second, and third reinforcing panels of a reinforcing shoulder are foldable so that the third reinforcing panel overlies a portion of the end wall, and the first and second reinforcing panels overlie a portion of the side wall when the end wall is hingedly displaced about the joint line toward the floor panel, with the edges of the first, second, and third reinforcing panels adjacent the dividing cut line positioned immediately adjacent the floor panel, when the end wall is pivoted about the joint line.

Brief Description of the Drawings

In the drawings, wherein like elements are referenced alike.

DETAILED DESCRIPTION OF THE PREFERRED EMBODIMENT

Figure 1:
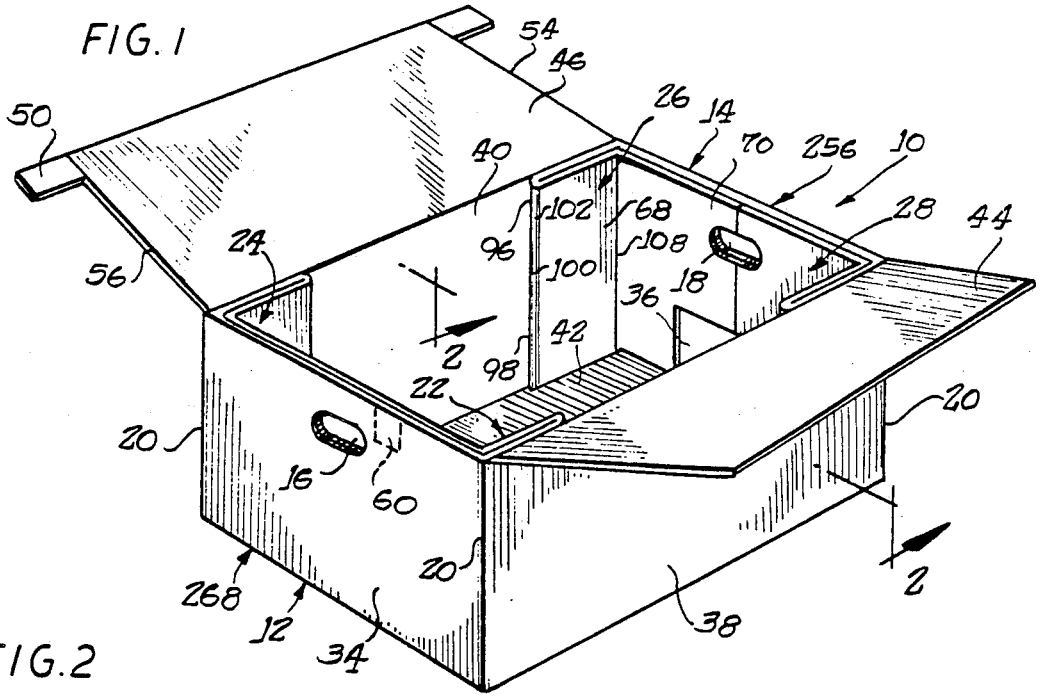
FIG. 1 is a perspective view of a carton illustrating aspects of the present invention.

Referring now to the drawings, and especially to FIG. 1, a carton, generally indicated at 10, illustrates aspects according to the present invention. The two ends 12, 14 have hand-hold cutouts 16, 18, respectively, for grasping and lifting the carton. Each end of the carton, as illustrated in FIG. 1, has three consecutive upstanding walls forming a pair of outside corners 20, with reinforcing shoulders 22–28 nested within the outside corners. One application for the carton, according to the present invention, is to provide an improved reinforcement when multiple cartons are stacked one on top of the other, with the corners of the cartons, as opposed to the mid-portions, bearing the column loading of cartons positioned thereabove. Accordingly, the ends 12, 14, the outside corners 20, and the inside reinforcing shoulders 22–28 are formed of multiple panels of a cardboard blank folded in an overlying, reinforcing relationship.

Carton 10 includes end walls or end panels 34, 36, preferably of single-ply construction, having hand-hold cutouts 16, 18, respectively, formed therein. Side walls 38, 40 extend between the end walls and in the finished stages of the carton, form outside corners 20 therewith. A floor 42, preferably integrally formed with the end walls and side walls, cooperates therewith to form a product-receiving receptacle. Cover panels 44, 46, when folded, enclose the upper open end of the box, defining an enclosed interior therewithin. Glue tabs 50, 52 extend from the ends 54, 56 of cover 46. With the cover 46 folded in a closed position, the glue tabs 50, 52 are folded over, and with an application of adhesive, are bonded to the end walls 34, 36 at portions 60, 62, respectively, on the outside surface of the end walls.

Figure 4:
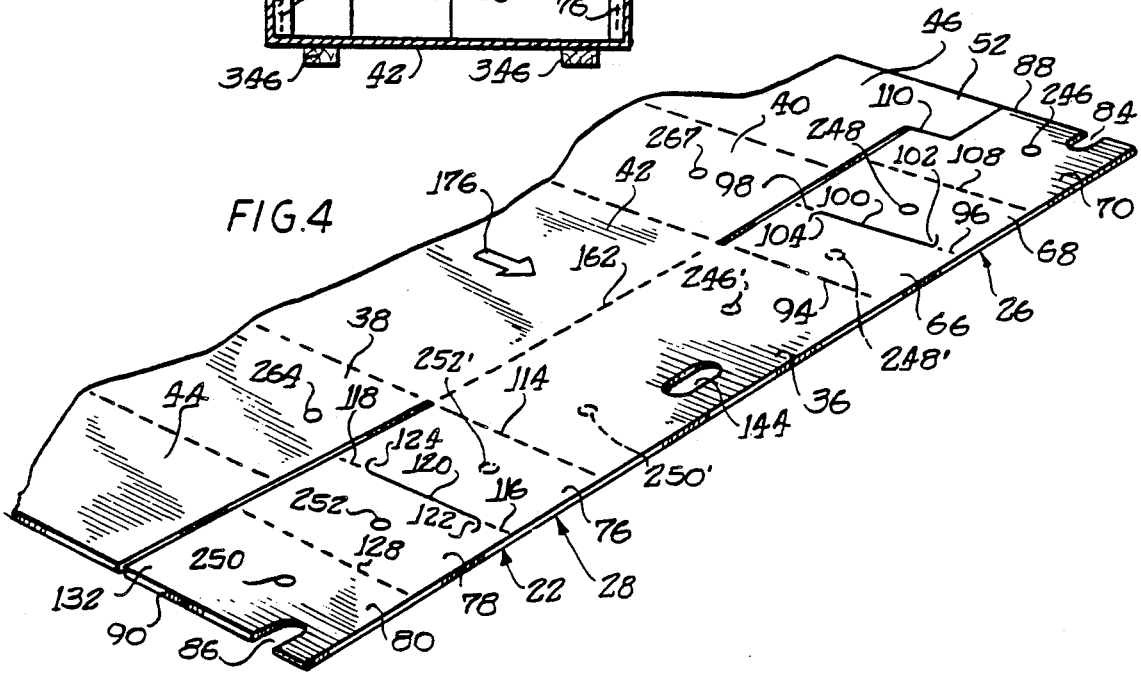
FIGS. 4–6 are fragmentary, perspective views of the blank of FIG. 3, showing the successive formation thereof into a reinforced corner of the carton of FIG. 1.
Figure 5:
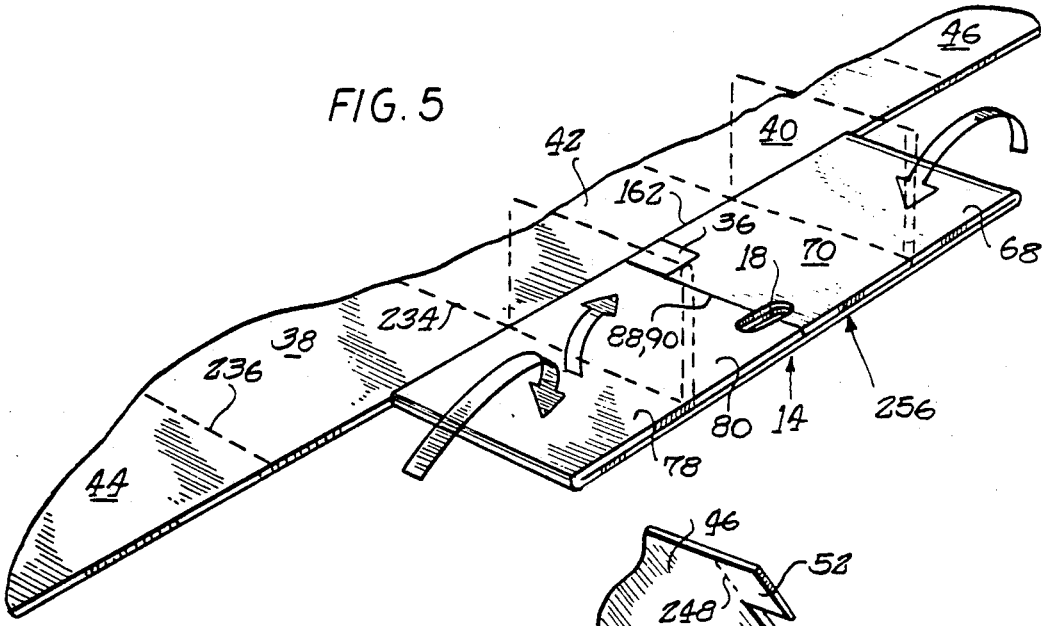
Figure 6:
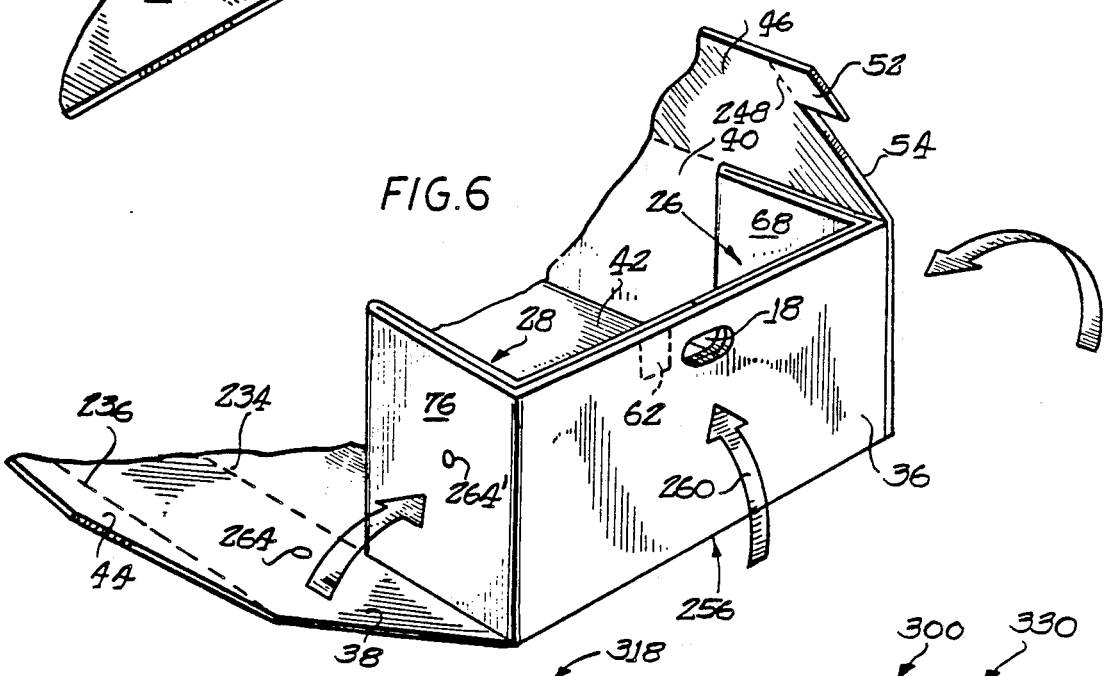

Referring now to FIGS. 4–6, the reinforcing shoulders 22–28 at the four corners of the carton, each comprise three panels. For example, the reinforcing shoulder 26 includes an inner panel 66, an intermediate panel 68, and an outer panel 70. Similarly, the reinforcing shoulder 28 includes an inner panel 76, an intermediate panel 78, and an outer panel 80. The outer panels 70, 80 include partial cutouts 84, 86 which extend inwardly from the free edges 88, 90 of outer panels 70, 80, respectively.

Referring again to the reinforcing shoulder 26, the inner panel 66 thereof, is joined to a lateral edge of panel 36 by an outer hinge line 94. Medial panel 68 is joined to the inner panel 66 by fold lines 96, 98 lying on either side of a central slit 100. The slit 100 has curved relief cuts or ends 102, 104 extending in opposite directions. The curved relief cut 102 is directed toward the medial panel 68, whereas the opposite curved relief cut 104 is directed to the inner panel. The fold lines 96, 98 lie on either side of slit 100 and extend to the opposed free edges of panels 66, 68. The intermediate and outer panels 68, 70 are joined by an inner hinge line 108. As can be seen in FIG. 4, outer panel 70 includes a step cut 110 intruding into the outer, lower corner thereof.

Reinforcing shoulder 28 is, except for the step cut 110, a mirror image of the reinforcing shoulder 26. Reinforcing shoulder 28, as mentioned above, includes inner, intermediate and outer panels 76, 78, and 80, respectively. Inner panel 76 is joined to a lateral edge of end wall 36 by an outer fold line 114. The inner and intermediate panels 76, 78 are joined by fold line segments 116, 118, lying on either side of a central slit 120. Curved relief cuts 122, 124 are located at each end of slit 120 and provide an accurate, controlled folding of the carton blank, along with controlled tear resistance. The curved relief cut 124 extends toward the inner panel 76, while the other curved relief cut 122 extends toward the intermediate panel 78. A fold line 128 joins intermediate and end panels 78, 80. End panel 80, unlike the opposed end panel 70, does not include a step cut therein, but rather has a solid outer corner 132.

Figure 3:
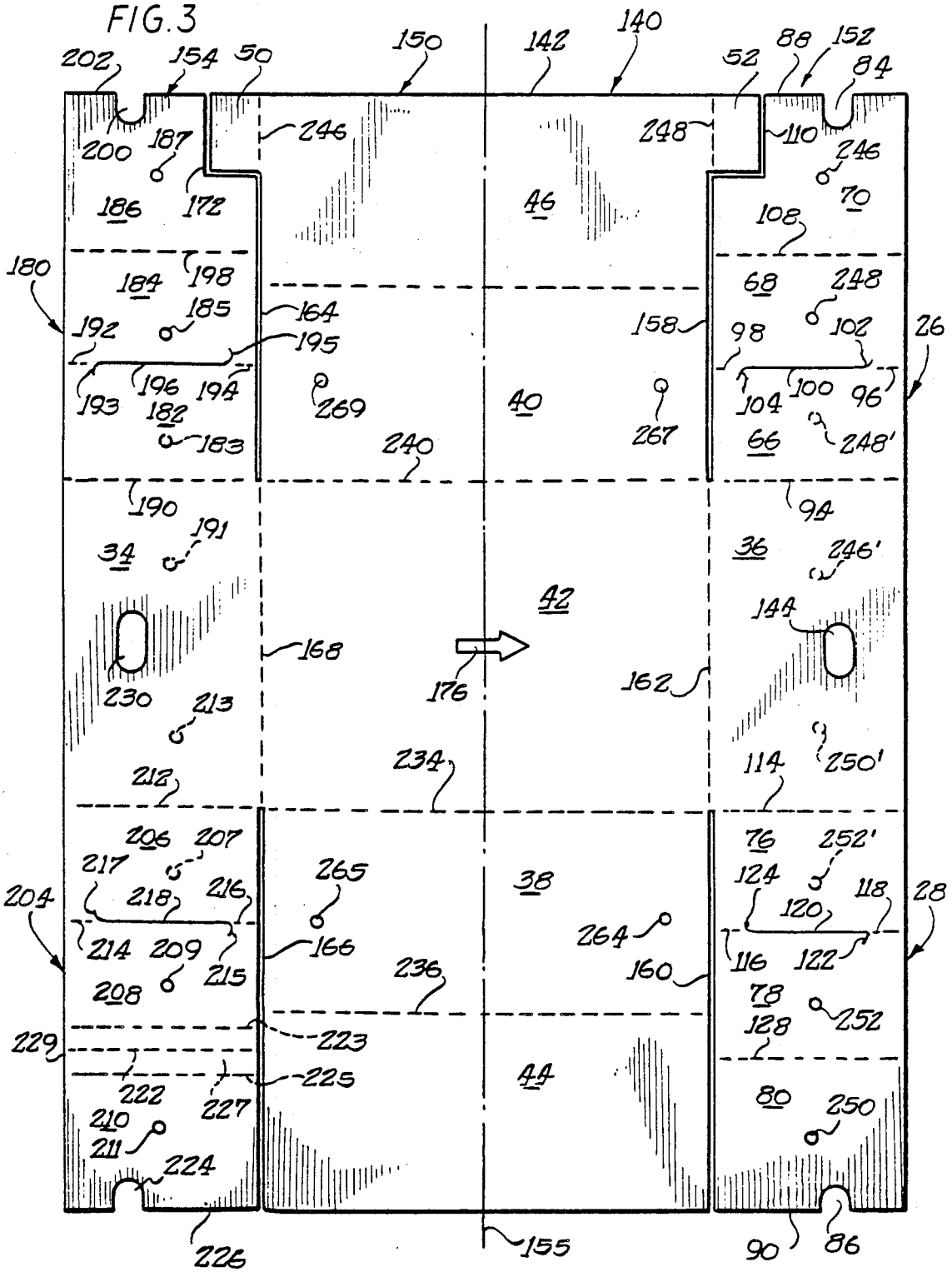
FIG. 3 is a plan view of a unitary blank from which the carton of FIG. 1 is formed.

Referring now to FIG. 3, a blank for forming carton 10 is generally indicated at 140. The carton blank is preferably formed from an integral sheet of corrugated cardboard material, such as that having an inner and outer liner, and an intermediate corrugated layer therebetween. The weight of the liners and the corrugated layer, can be chosen as desired, for achieving a carton with a specified minimum strength. According to one aspect of the present invention, the carton blank 140 has a general rectangular outer perimeter 142, with only a minimum of material removed therefrom. For example, the material removed from blank 40 includes the partial cutouts 84, 86 formed in outer panels 70, 80, and a hand-hold cutout 144 formed in end wall 36. The opposing portion of the blank has similar cutout portions, as will be explained in the following description.

As can be observed from examining the overall configuration of carton blank 140, the blank is divided into three columns, a central column 150 and intermediate outer columns 152, 154. The outer column 152 has been described above with reference to FIG. 4. Except for the relief cuts, the opposing outer column 154 essentially comprises a mirror image of column 152 taken about the centerline 155, as will be seen in greater detail herein. One distinguishing feature of the carton blank, according to the present invention, is that no material is removed from the central column 150, thus contributing greatly to the strength and ease of fabrication of the carton.

The division between the central column 150 and outer column 152 comprises a first cut line 158, extending principally along the reinforcing shoulder 26. Step cut 110 extends from the outer end of cut line 158, comprising an offset portion thereof at the outer, bottom corner of panel 70. A cut line 160 colinear with cut line 158, extends along the second reinforcing shoulder 28. A fold line 162 colinear with the cut lines 158, 160, and intermediate therebetween, joins floor 42 and end wall 36. Fold line 162 comprises a first end wall-floor joint forming a hingeable connection between the floor and one end wall.

As mentioned above, one distinguishing feature of carton blank 140 (except for the orientation of its relief cuts) is the symmetry about its longitudinal center line 155. Accordingly, the central column 150 is separated from the outer column 154 by cut lines 164, 166, disposed on either end of a fold line 168. A second step cut or offset 172, extends from the outer end of cut line 164. The cut lines 164, 166 and the intermediate fold line 168 are colinearly arranged.

Preferably, carton blank 140 is initially processed to form the cut lines and fold lines separating the central and outer columns. Thereafter, the various fold lines extending in a transverse direction are formed in the carton blank, the blank thereafter being fed in the direction of arrow 176 in a separate carton-forming operation, wherein the various walls and panels of the cartons are folded into the desired configuration of FIG. 1.

Referring again to FIG. 3, a reinforcing shoulder 180, laterally opposite the reinforcing shoulder 26 includes inner, intermediate and outer panels 182, 184 and 186, respectively. An outer hinge line 190 joins a lateral edge of the end wall 34 to inner panel 182. Fold lines 192, 194 and a central cut line 196 intermediate therebetween, lie between the inner and intermediate panels 182, 184. Curved relief cuts 193, 195 extending toward the inner and intermediate panels 182, 184, respectively, are formed at the ends of cut 196. An inner hinge line 198 joins intermediate panel 184 to outer panel 186 which, as mentioned above, includes the step cut 172, and further includes a partial cutout 200.

The remaining reinforcing shoulder 204 includes inner, intermediate and outer panels 206, 208 and 210, respectively. Cut line 218 is terminated in curved relief cuts 215, 217 directed toward panels 208, 206, respectively. As can be seen, the opposing relief cuts 217, 215 extend in opposite directions. As pointed out above, the curved relief cuts are exceptions to the symmetry of columns 152, 154 about center line 155. Inner panel 206 is joined to a lateral edge of the end panel 34 by an outer hinge line 212. The fold lines 214, 216 and central cut line 218, all colinearly arranged, divide inner and intermediate panels 206, 208. An inner hinge line 222 joins the intermediate and outer panels 208, 210. A partial cutout 224 extends inwardly from the outer free edge 226 of panel 210. A cutout 230 is formed in end wall 34.

The fold line 234 comprises the side wall-to-floor joint hingeably connecting floor 42 to side wall 38. The fold line 236 hingeably joins cover 44 to side wall 38, and extends parallel to the fold line 234. Similarly, the fold line 240 comprises the floor-to-side wall joint hingeably connecting floor 42 to side wall 40, and fold line 242 hingeably joins side wall 40 to cover 46. Cover 46 further includes fold lines 246, 248, hingeably connecting the cover to outwardly-extending glue flaps 50, 52, formed by the step cuts 172, 110, respectively. Referring now to FIGS. 4–6, the assembly of carton 10 will be described.

As will be appreciated by those skilled in the art, carton 10 can be erected either by hand, or by using conventional box-forming machinery components. In the commercial embodiment, machine fabrication is preferred with carton blank 140 being fed into the forming machine in the direction of arrow 176, that is, with the outer free end of column 152 forming the leading end. In a next step, adhesive 246' is applied to end wall 36 and adhesive 248' is applied to inner panel 66. Similarly, adhesive 250' is applied to end wall 36, and adhesive 252' is applied to inner panel 76.

The outer and intermediate panels 70, 68 are pivoted as a unit about the hinge line formed by fold segments 96, 98 and central slit 100. The adhesive 246' contacts the area on outer panel 70, identified by the reference numeral 246. Also, the adhesive 248' forms a bond with the area 248 on intermediate panel 68. Concurrently, the panels 78, 80 are folded as a unit about the hinge line, formed by fold segments 116, 118 and the central slit 120, the adhesive portions 250', 252' contacting the areas 250, 252 on outer panel 80 and intermediate panel 78, respectively. Thus, the construction illustrated in solid in FIG. 5, is produced with the partial cutouts 84, 86 aligned in registry with the cutout 144 of panel 36, to form the hand-hold cutout 18. The free end portions 88, 90 of outer panels 70, 80 are located adjacent each other in abutting relationship.

Next, the inner and intermediate panels 66, 68 of the reinforcing shoulder 26, are upwardly bent at right angles to the position illustrated in phantom in FIG. 5. The inner and intermediate panels 76, 78 are likewise bent to form a right angle, with end wall 36 and the outer panels 70, 80, overlying that end wall. The resulting construction, generally indicated at 256, has a generally U-shaped configuration of double wall thickness. The construction 256 includes a bight portion comprising the carton end 14, consisting of the joinder of end wall 36, and the outer panels 78, 80. The legs of the construction 256 include the bonded joinder of panels 66, 68 and 76, 78. Next, the U-shaped construction 256 is pivoted in the direction of arrow 260, as shown in FIG. 6, being folded about the hinge line 162. According to one aspect of the present invention, the bottom edges of panels 76, 78 and 80 contact the floor 42, as do the panels 66, 68 and 70 at the other leg of the U-shaped construction.

Referring now to FIG. 6, adhesive 264 is applied to side wall 38, and adhesive 267 is applied to side wall 40. While maintaining the lower edges of the reinforcing shoulders 26, 28 in contact with floor 42, the side walls 38, 40 are folded about their respective hinge lines or joints 234, 240, respectively. This brings the adhesive portions 264, 266 into contact with the outer surfaces of the inner panels 76, 66. For example, the adhesive portion 264 contacts the area 264' of inner panel 76, as illustrated in FIG. 6, to bond the side panel and U-shaped construction together, and to hold the U-shaped construction in contact with or immediately adjacent to, the floor 42.

The opposing end of blank 140, along column 154, is assembled in a manner substantially identical to FIGS. 5 and 6, so as to form a U-shaped construction generally indicated at 268 (see FIG. 1). The second U-shaped construction 268 is configured before the side walls 38, 40 are pivoted to an upright position, so that the adhesive joinder, with the inner panels of the reinforcing shoulders 22, 24, will also become bonded to the side walls 38, 40. A U-shaped construction is formed with end wall 34, comprising the intermediate or bight portion, the panels 182–186 comprising one leg, and the panels 206–210 comprising the other leg. Adhesives 183 and 191 are applied to panels 182 and 34, respectively. While maintaining panels 184, 186 in a generally coplanar alignment, the panels are folded about the fold line segments 192, 194 and the central slit portion 196. Upon folding, adhesive 183 bonds panels 182, 184 together, contacting area 185 on panel 184. Also, the adhesive 191 contacts area 187 on outer panel 186, so as to form a bond between the outer panel 186 and end wall 34. Thus, the fold line segments 192, 194 comprise an outwardly-facing edge of the folded arrangement. Next, the overlying, bonded panels 182, 184 are simultaneously folded about their fold lines 190, 198 as the panels are erected at a right angle to end wall 34.

Assembly of the remaining leg of the U-shaped construction continues with the application of adhesive 213 to end wall 34, and adhesive 207 to panel 206. The two panels 208, 210 are folded as a unit about the fold line segments 214, 216, bringing adhesive 207 in contact with area 209 of panel 208, and also bringing the adhesive 213 into contact with the area 211 of outer panel 210. The double layer subassembly is then folded about the fold segments 212, 222, the panels 206, 208 forming approximately a right angle with the end wall 34, being concurrently folded about their fold lines 212, 222, respectively. The resulting U-shaped construction is then folded about joint line 168, with end wall 34 being erected to form a generally right angle with the floor panel 42. As with the other end of the carton, the lower edges of panels 206–210 are brought into contact with floor panel 42 adjacent the joint line 234, and the lower edges of panels 182–186 are brought into contact with the opposite side of floor panel 42, adjacent joint line 240.

Thereafter, the adhesive portion 264 is applied to one end of side wall 38, and an adhesive portion 265 is applied to the opposite end of the side wall. Adhesive portions 267 and 269 are applied to the ends of side wall 40. The side walls are then erected, forming a generally right angle with the floor panel 42, thereby bringing their respective adhesive portions into contact with the outer surfaces of the legs of the U-shaped constructions at each end of the carton.

The above-described assembly sequence where the ends of the carton are prepared one at a time, is only one manner of assembling the carton according to aspects of the present invention. As will be appreciated by those skilled in the art, economies of manufacture in many product areas are attained only with a fully automated fabrication. Accordingly, a brief description of a fully automated assembly of the carton will now be described. The carton blank 140 is advanced toward automated gluing and assembly machinery in the direction of arrow 176, as illustrated in FIG. 3. Adhesive is applied to the carton blank as the blank is advanced into contact with a mandrel portion of a Pearson machine, widely recognized by those skilled in the art. Adhesive is preferably applied in stripes, with multiple point spray heads, as the blank travels underneath the heads. Adhesive is applied in the following order, described herein with reference to FIG. 3. In a first step, adhesive portions 246', 248', 250' and 252' are applied to the upstream end of the carton blank, i.e., portions of column 152. Next, in a second portion of the sequence, adhesive portions 267, 264 are applied to the leading half of central portion 150. Thereafter, in a third step, adhesive portions 265, 269 are applied to the trailing half of the central column 150. In a final stage, adhesive portions 183, 191, 213 and 207 are applied to the trailing end of the carton blank, at portions along column 154.

With further advancement of the carton blank, folding rails fold the carton blank about the fold lines between the inner and intermediate panels of the reinforcing shoulders 26, 28. With further advancement of the carton blank, folding rails then perform a similar function at column 154 of the blank, where the blank is folded along the fold lines separating the inner and intermediate panels. The relief cuts at these four folding lines greatly increase the efficiency and accuracy of the automated folding process.

If the preliminary folding of the reinforcing shoulder is being completed, the floor 42 of the carton blank is contacted by the aforementioned mandrel of the Pearson machine, with folding about the periphery or edges of the floor 42 occurring in rapid order, thereby erecting the sides and end walls of the cartons at substantially right angles about the floor 42. First, the reinforcing shoulders at the ends of the carton are folded in a two-step sequence, as illustrated above with reference to FIGS. 5 and 6. Thereafter, the side panels are folded into a fully upright position contacting the reinforcing shoulders, and thus performing the bonding therewith, the adhesive previously being applied as described above.

As described briefly above, the curved relief cuts at the ends of the central slits 100, 120, 196 and 218 greatly facilitate the fabrication of the carton blank to form the carton 10, as described above. The function of the relief cuts and the orientation relative to the carton blank 140 will now be described in greater detail. As mentioned above, carton 10 is preferably formed of corrugated board material. When corrugated board is folded with a 180° fold, bringing portions thereof into contact with each other, the corrugated board has been observed to "bind" when score lines or central slit portions, without the relief cuts, are provided. The binding is due, in part, because of the thickness of the corrugated board, wherein a corrugated medium is located between inner and outer paper liners. As the strength requirements of the carton are increased, the weight or thickness of the liners and of the corrugated medium is increased appropriately, thereby contributing significantly to the overall thickness of the corrugated board material. There are several difficulties encountered when heavier weight corrugated panels are folded about a simple score line. In addition to the mechanical resistance to folding, the two folded pieces of corrugated board are forced apart, and a bias force is created in the material, which tends to defeat satisfactory bonding at adhesive joints. Corrugated material adjacent the score line, is formed and sometimes creates undesirable scores, causing the folded panel to come out of its desired alignment, as the fabrication thereof into a carton progresses step-by-step. In addition to the misaligning forces created in a simple score line, forces created by flap folding machinery are added thereto, tending to further aggravate the misalignment.

Figure 7:
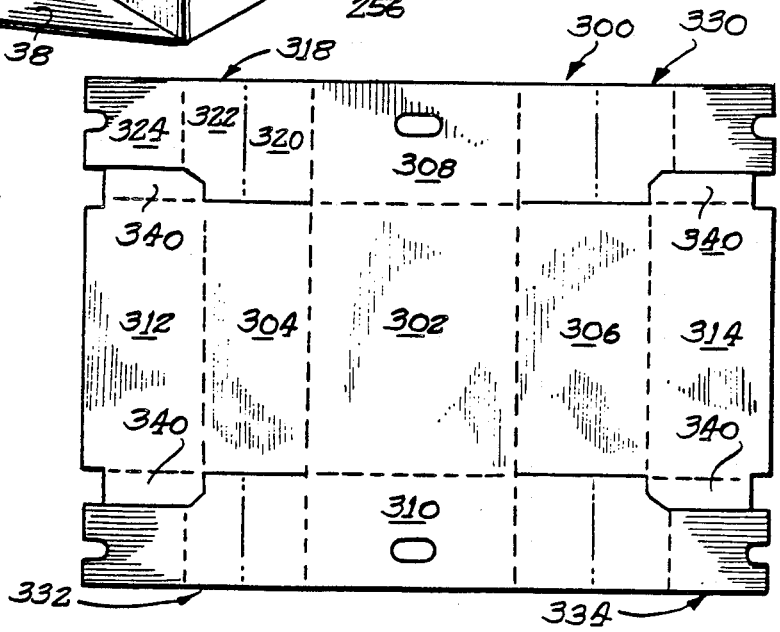
FIG. 7 PRIOR ART
FIG. 7 is a plan view of a prior art carton blank.

These problems have been observed in the blank 300 of FIG. 7 at the point of folding between inner and intermediate panels 322, 320, respectively. Increasing the length of the score line between these panels, to an extent necessary to cause an appreciable improvement in bending performance, is undesirably long, tending to weaken the carton. While some of the problems associated with folding are alleviated, the fold line is still observed to be skewed, and tearing has been found to occur at the ends of the central slit portion. It has been found that the curved relief cuts at the ends of the slit can be provided with a radius of curvature, which minimizes or eliminates the problems described above. The curved relief cuts are preferably formed to extend in a direction opposite to the direction of tearing stresses in the carton blank when folded at the fold line. It has also been found that the curved relief cuts associated with a particular fold line extend in directions opposite to each other, with the leading ends of the cut lines extending away from each other, toward outer portions of the carton blank. For example, referring to FIG. 3, with a carton blank 140 advanced in the direction of arrow 176, the curved relief cuts 102, 118 are located at the leading ends of the slit portions 100, 120. The curved relief cuts 102, 118 extend away from each other toward opposing edges of the carton blank, whereat the partial cutouts 84, 86 for the hand-holds, are formed. As the carton blank is advanced toward the folding machinery, and the downstream column 154 is folded, the curved relief cuts 195, 215 are located at the leading end of the remaining portion of blank 140. As before, the curved relief cuts 195, 215 extend away from each other in a manner similar to the relief cuts 102, 118. Because of the automated assembly of the carton blank as described above, the opposed pairs of curved relief cuts 195, 104, and 215, 124 do not extend in the same direction, and thus comprise an exception to the symmetry about center line 155, as has been pointed out above.

An important feature, according to the present invention, is that the reinforcing shoulders extend between and contact the covers 44, 46 and the floor, when the carton is placed under a compressive load, as where additional cartons are loaded on top of carton 10. As illustrated in FIG. 1, substantially the entire portion of the reinforcing shoulder 26 is in contact with the floor 42, except for that small portion defined by step cut 110. The reinforcing shoulder 24 has a similar step cut 172, to provide the formation of glue flap 50. However, the remaining reinforcing shoulders 22, 28 are fully in contact with the floor 42 throughout their length. This provides a surprising improvement in performance, notably carton strength, as opposed to the prior art carton blank 300 of FIG. 7.

Referring now to FIG. 7, the blank 300 has a floor portion 302, side wall portions 304, 306 and end walls 308, 310. Cover portions 312, 314 are formed at the outside edges of side walls 304, 306, respectively. The reinforcing shoulders are formed at either side of the end panels 308, 310. For example, the reinforcing shoulder 318 includes inner, intermediate and outer panels 320, 322, and 324. The remaining reinforcing shoulders 330, 332 and 334 are substantially identically formed.

A principal distinction between the carton blank 300 and the carton blank 140 according to principles of the present invention, is that the carton blank 300 has glue tabs 340 at each corner of the box, each glue tab extending throughout the entire portion of an outer panel of the reinforcing shoulder, and a significant portion of the intermediate panel. Thus, the reinforcing shoulders do not support the end walls 308, 310 when compressively loaded, and support only minor portions of the side walls with a double wall reinforcement, forming a final, triple wall thickness.

As will be appreciated by those skilled in the art, satisfactory carton performance is due not only to the support of the end walls and side walls when under compression, but is also dependent upon adequate strength in the joinder of the covers to one or more wall portions. Accordingly, the glue tabs 340 of carton blank 300 were found to be necessary to provide the desired cave-in strength. According to one aspect of the present invention, adequate cave-in strength is provided with relatively smaller glue tabs and the compression strength is remarkably increased. For example, standard compression tests conducted on the improved carton, according to the present invention, exhibited a 40% increase in loading, compared to the carton constructed from the blank 300 of FIG. 7.

As will be appreciated by those skilled in the art, standard compression tests are performed with the the floor of the carton fully supported throughout its entire surface area. However, those having experience in the shipping industry, will readily appreciate that at times, a carton is not fully supported throughout the entire area of its floor. As a result, a carton may partially overhang a support, such as a pallet or the like. When additional cartons are placed on top, the rate of failure of the carton is usually accelerated.

Figure 2:
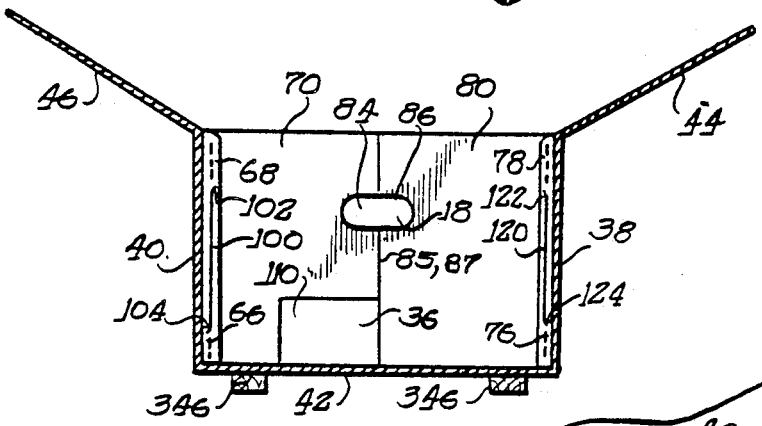
FIG. 2 is a cross-sectional elevational view taken along the line 2—2 of FIG. 1.

An unexpected 83% improvement has been observed in a standard compression test, modified to approximate a typical overhang condition. Referring to FIG. 2, the compression test was performed with wooden structural supports 346, inset from the side walls 38, 40 of the carton, and running the entire length of the carton. A standard commercial carton produced from the blank 300 of FIG. 7, and the improved carton according to the principles of the present invention, were constructed with a floor measuring approximately 17"×22" at its perimeter. The supports 346 each comprised a 2×4 lumber inset, approximately 2 to 3 inches from the side walls 38, 40, that is, the 2×4 lumber was placed on approximately 11" centers, centered on the 17 inch wide end wall of the cartons. Applying the elements of a standard compression test to the cartons, the carton constructed according to principles of the present invention, exhibited an 83% improvement over the maximum loadbearing strength of a carton constructed with the blank 300 of FIG. 7.

These improvements in performance are obtained with a carton blank having less material removal than the blank 300 of FIG. 7, and providing acceptable cave-in strength of the upper portion. It is generally preferred in this regard, that the commercial embodiment of the carton 10 described above be constructed so that the covers 44, 46 overlap one another approximately 2½ inches for a carton 17 inches wide. The flap 46 with the glue tabs 50, 52, is lowered first, and the cover 44 is then lowered on top thereof and bonded thereto, using any suitable means.

Referring again to FIG. 3, an alternative embodiment of carton 10 and blank 140 will be described, with reference to a modification of the blank illustrated in FIG. 3. As described above, a fold line 222 is provided between intermediate and outer panels 208, 210, respectively. This fold line, as a result of the folding sequence described above, is located at an inside corner of the carton when the blank is fully formed. With the blank as described above, the panels 208, 210 are formed at generally right angle to each other, and must form a reinforcing shoulder, having an upper edge which is L-shaped when viewed in plan. According to another aspect of the present invention, the fold line 222 can be replaced with a pair of fold lines 223, 225, as illustrated in phantom in FIG. 3. The alternative pair of fold lines 223, 225 replaces the fold line 22. The alternative fold lines 223, 225 are spaced in relatively small amounts from fold line 222, and preferably extend parallel thereto. As before, the panels 208, 210 will be folded at generally right angles to one another. However, in place of the inside 90° corner, a relatively narrow panel 227 connects the panels 208, 210. The top edge 229 of panel 227 extends into the interior of the carton so as to form a triangular configuration with the adjacent corners of end wall 34 and side wall 38. Thus, in effect, the area of the top edge of the reinforcing shoulder has effectively been increased, without requiring additional corrugated panel material, and without requiring the use of supplementary components. If desired, the triangular corner construction of panel 227 can be duplicated at one or more of the remaining three corners of the carton, if the relatively minor decrease in internal volume of the carton caused thereby does not present a problem.

Thus, a carton is formed from an integral blank, so as to have improved compression strength without the use of separate reinforcements. It will now be seen that the objects hereinbefore set forth, may readily and efficiently be attained and, since certain changes may be made in the above construction and different embodiments of the invention, without departing from the scope thereof, it is intended that all matter contained in the above description or shown in the accompanying drawings shall be interpreted as illustrative and not in a limiting sense.

What is claimed is:

1. A carton blank from which a carton is formed, having an end with three consecutive upstanding walls forming a pair of spaced-apart outside corners with reinforcing shoulders nested within each outside corner, the blank having a substantially rectangular configuration, the blank comprising:

a floor panel having two pairs of opposed edges with side wall panels joined to one of the pairs of opposed edges of the floor panel, and with top cover panels on either side of said side wall panels and joined thereto with fold lines;

end wall panels joined to the second pair of opposed edges of the floor panel by respective flexible joint lines, each end wall panel having a pair of generally opposed lateral edges;

a reinforcing shoulder extending from each lateral edge of the end panels to opposed peripheral edges of the blank, each reinforcing shoulder including first, second and third serially adjacent reinforcing panels, the first reinforcing panel hingedly connected to a lateral edge of the side wall panel along a first hinge line, the first, second and third reinforcing panels of each reinforcing shoulder extending along one side of adjacent side wall and top cover panels such that the first panel and a portion of the second panel extend along the sidewall panel and such that the remaining portion of the second panel and the third panel extend along the cover panel;

one pair of laterally opposed reinforcing shoulders generally coextensive with one of said sidewall panels with one cover panel located therebetween, so that the one cover panel and the reinforcing shoulders have free edges at one said peripheral edge of the blank;

said one cover panel having a pair of opposed edges extending from a free edge of said one cover panel so as to form corners of the cover panel thereat, the opposed edges located opposite a pair of third reinforcing panels, respectively;

a tab formed exclusively in only one pair of said third reinforcing panels so as to extend from said one cover panel adjacent a corner thereof;

a second hinge lines joining each pair of first and second reinforcing panels so that said second and said third reinforcing panels can be folded against said first reinforcing panel and said end wall, respectively;

third hinge lines joining said second and said third reinforcing panels, the third hinge lines located closer to the peripheral edge of the blank than the fold lines joining the cover and sidewall panels, and said third hinge lines positioned to lie adjacent said first hinge line when said first and said second reinforcing panels are folded about said second hinge line;

said third reinforcing panels configured to have a lower edge lying immediately adjacent the joint line joining the end wall and floor panel when said second and said third reinforcing panels are folded about said second hinge line;

said first and second panels thereafter foldable about said first and said third hinge lines so that the lower edges thereof and the lower edges of said third reinforcing panel are positioned immediately adjacent the floor panel when said side wall is folded about the joint line toward the floor panel; and edges of said first, second and third reinforcing panels together comprising a substantially continuous edge forming a colinear extension of said joint line;

whereby said first, second and third reinforcing panels cooperate to form a reinforcing shoulder reinforcing adjacent ones of said side walls and said end walls.

2. The carton blank of claim 1 wherein said first and said second reinforcing panels define a slit segment along said second hinge line.

3. The carton blank of claim 2 wherein said first and said second reinforcing panels define curved cut portions on the ends of said slit segment, one curved cut portion extending toward the first reinforcing panel and the other curved cut portion extending toward the second reinforcing panel.

4. The carton blank of claim 3 wherein said second hinge line includes a pair of spaced apart hinge segments on either side of said slit segment and said curved cut portions, said hinge segments extending between said curved cut portions and free edges of the first and second reinforcing panels.

5. The carton blank of claim 1 wherein said first, second and third reinforcing panels, one said side wall and said top panel together comprise an integral portion of the carton blank wherein edges of said first, second and third reinforcing panels oppose edges of said side wall and said top panel, being separated therefrom by a common cut line.

6. The blank according to claim 1 wherein said tabs have a free edge at said one peripheral edge of the blank.

7. A carton blank from which a carton is formed, having an end with three consecutive upstanding walls forming a pair of spaced-apart outside corners with reinforcing shoulders nested within each outside corner, comprising:

a floor panel having two pairs of opposed edges with side wall panels joined to one of the pairs of opposed edges of the floor panel, and with top cover panels on either side of said side wall panels;

end wall panels joined to the second pair of opposed edges of the floor panel by respective flexible joint lines, each end wall panel having a pair of generally opposed lateral edges;

a reinforcing shoulder extending from each lateral edge of the end panels, the reinforcing shoulder including first, second and third serially adjacent reinforcing panels, the first reinforcing panel hingedly connected to a lateral edge of the side wall panel along a first hinge line, the first, second and third reinforcing panels of each reinforcing shoulder extending along one side of adjacent side wall and top cover panels;

second hinge lines joining each pair of first and second reinforcing panels so that said second and said third reinforcing panel and said end wall, respectively;

said first and said second reinforcing panels defining a slit segment along said second hinge line with said first and said second reinforcing panels defining curved cut portions on the ends of said slit segment, one curved cut portion extending toward the first reinforcing panel and the other curved cut portion extending toward the second reinforcing panel;

third hinge lines separating said second and said third reinforcing panels and positioned to lie adjacent said first hinge line when said second and third reinforcing panels are folded about said second hinge line;

said third reinforcing panels configures to have a lower edge lying immediately adjacent the joint line joining the end wall and floor panel when said second and said third reinforcing panels are folded about said second hinge line;

said first and second panels thereafter foldable about said first and said third hinge lines so that the lower edges thereof and the lower edges of said third reinforcing panel are positioned immediately adjacent the floor panel when said side wall is folded about the joint line toward the floor panel; and edges of said first, second and third reinforcing panels together comprising a substantially continuous edge forming a colinear extension of said joint line;

whereby said first, second and third reinforcing panels cooperate to form a reinforcing shoulder reinforcing an adjacent side wall and end wall.

8. The carton blank of claim 7 wherein said second hinge line includes a pair of spaced apart hinge segments on either side of said slit segment and said curved cut portions, said hinge segments extending between said curved cut portions and free edges of the first and second reinforcing panels.

9. A carton blank from which a carton is formed, having two opposed ends, each end including three consecutive upstanding wall portions forming a pair of spaced-apart side corners with reinforcing shoulders nested within each outside corner, comprising:

a generally rectangular sheet of carton material;

three columns defined by said sheet including a central column and two outer columns;

the central column including a centrally located floor panel, side wall panels on either side of said floor panel and cover panels on either side of said side wall panels having a free edge at the periphery of the blank and joined to the sidewall panels with first hinge lines;

each outer column including a centrally-located end wall generally coextensive with said floor panel and a reinforcing shoulder on either side of said end wall generally coextensive with a laterally adjacent side wall and a laterally adjacent top cover panel of the central column;

each reinforcing shoulder including a first panel hingedly connected to one lateral edge of the end wall, a second panel on either side of the first panels and, a third panel on either side of the second panels;

said side wall and at least a portion of said top cover panels being divided from said reinforcing shoulders by a generally straight dividing cut line colinear with the joint line joining the end wall and floor panel the dividing cut line extending to the top cover panel free edge to form a corner thereat, opposing third reinforcing panels of each outer column extending to a free edge of one top cover panel and having an edge adjacent the dividing cut line;

a tab formed exclusively in only one pair of said third reinforcing panels so as to extend from said one top cover panel adjacent the corners thereof, said tabs providing a joining to the end wall panels for reinforcement of said other top cover;

said first and second reinforcing panels joined together by a second hinge line and said second and third reinforcing panels joined by a third hinge line, the first, second and third reinforcing panels of a reinforcing shoulder being foldable so that the third reinforcing panel overlies a portion of the end wall and the first and second reinforcing panels overlie a portion of the side wall when the end wall is hingedly displaced about the joint line toward the floor panel, with the edges of the first, second and third reinforcing panels adjacent the dividing cut line positioned immediately adjacent the floor panel when the end wall is pivoted about the joint line; and ones of the third hinge lines which are adjacent the tabs being located closer to the one peripheral edge of the blank than ones of the first hinge lines which extend along the cover panel which is located between the tabs.

10. The blank according to claim 9 wherein said tabs have a free edge at said one peripheral edge of the blank.

* * * * *

UNITED STATES PATENT AND TRADEMARK OFFICE
CERTIFICATE OF CORRECTION

PATENT NO. : 5,000,377

DATED : March 19, 1991

INVENTOR(S) : Jack A. McClure

It is certified that error appears in the above-identified patent and that said Letters Patent is hereby corrected as shown below:

IN THE CLAIMS:

In Claim 1, Column 12, line 49, before the word "second" delete the word "a".

In Claim 5, Column 13, line 28, after the word "and" insert the word --one--.

In Claim 7, Column 13, line 61, after the word "reinforcing" insert the phrase --panels can be folded against said first reinforcing--.

In Claim 7, Column 14, line 8, change "configures" to read the word --configured--.

Signed and Sealed this

Eighteenth Day of October, 1994

*Attest:*

*Attesting Officer*

Bruce Lehman

BRUCE LEHMAN

*Commissioner of Patents and Trademarks*